United States Patent [19]

Kinnebrew, IV

[11] 4,429,502

[45] Feb. 7, 1984

[54] TRANSIT SHELTER

[76] Inventor: Joseph E. Kinnebrew, IV, 13300 Beckwith Dr., NE., Lowell, Mich. 49331

[21] Appl. No.: 245,159

[22] Filed: Mar. 18, 1981

[51] Int. Cl.[3] ..... E04C 3/30

[52] U.S. Cl. ..... 52/263; 52/79.1; 52/730; 52/731; 52/656

[58] Field of Search ..... 52/36, 79.1, 79.9, 79.12, 52/263, 238.1, 239, 280, 281, 288, 726, 656, 730, 731, 282, 764, 780

[56] References Cited

U.S. PATENT DOCUMENTS

| | | | |
|---|---|---|---|
| 3,420,505 | 1/1969 | Jefferys | 52/731 X |
| 4,114,330 | 9/1978 | Sukolics | 52/764 X |
| 4,117,640 | 10/1978 | Vanderstar | 52/730 |
| 4,211,179 | 7/1980 | Saunders | 52/731 X |

FOREIGN PATENT DOCUMENTS

| | | | |
|---|---|---|---|
| 2608331 | 8/1977 | Fed. Rep. of Germany | 52/656 |

*Primary Examiner*—J. Karl Bell

*Attorney, Agent, or Firm*—Price, Heneveld, Huizenga & Cooper

[57] ABSTRACT

An exoskeletal shelter structure is disclosed which has laterally spaced, parallel, exoskeletal curvilinear ribs extending the height and length of said structure. Each rib has a mullion or strut coupled to cooperative elongated compression plates. A rib spacing curvilinear panel extending along the top and the ends is retained in retention slots between the mullion and pressure plates. The ribs continue along the sides of the structure to form side space mullions defining side spaces receiving side panels.

34 Claims, 14 Drawing Figures

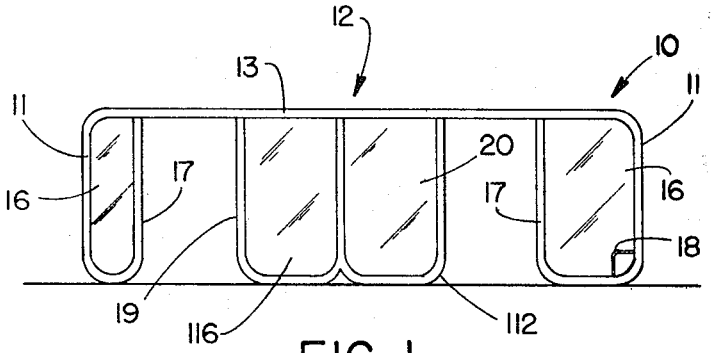
FIG. 1
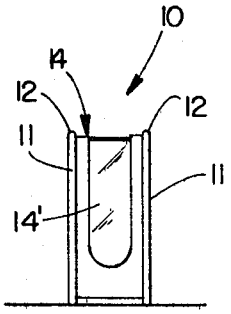
FIG. 2
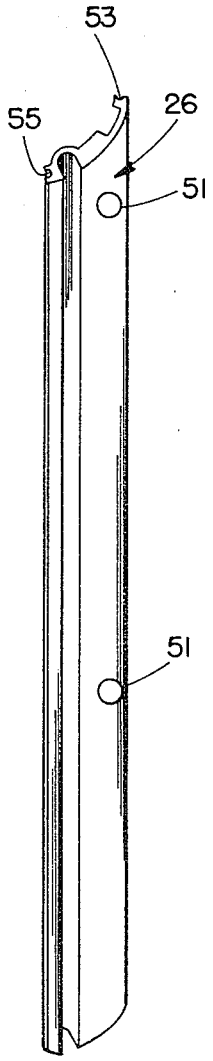
FIG. 5
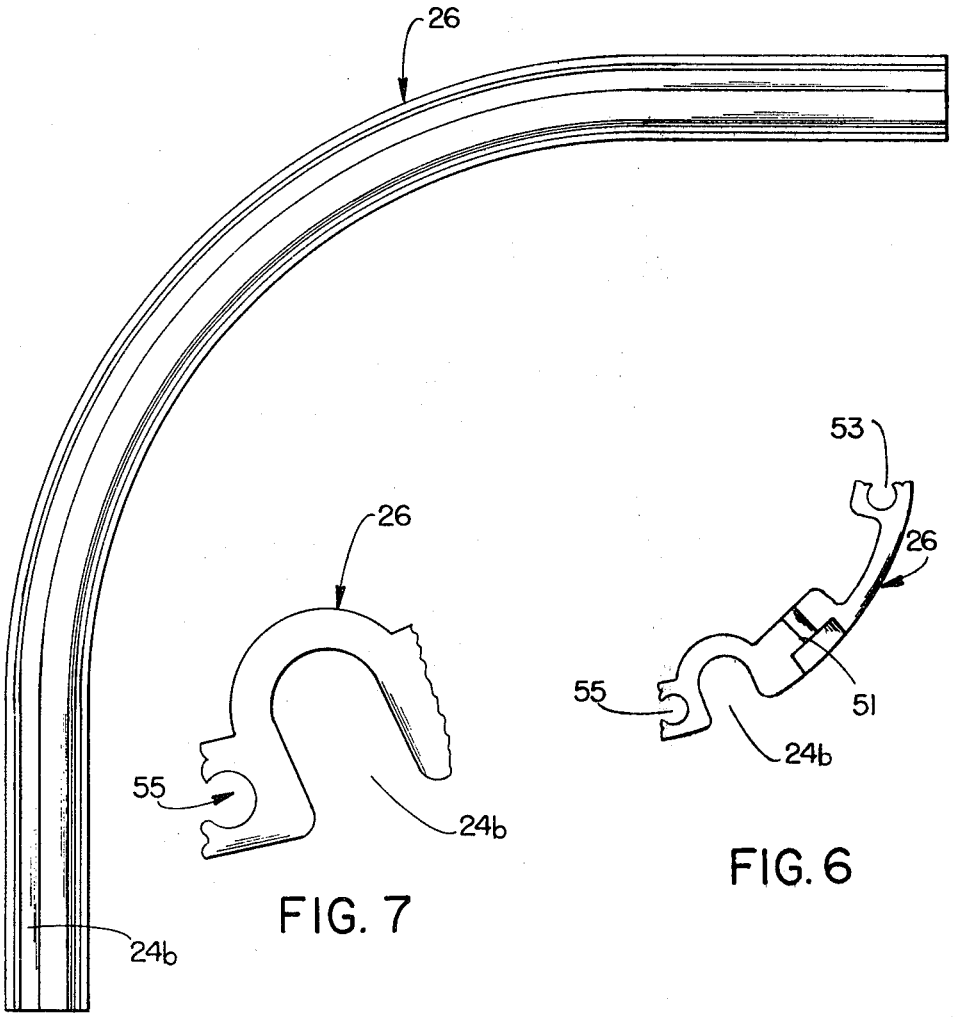
FIG. 3
FIG. 7
FIG. 6

TRANSIT SHELTER

BACKGROUND OF THE INVENTION

This invention relates to exoskeletal structures, particularly shelters such as transit shelters.

Shelter accommodation of transit passengers for rail and bus systems should achieve several things, namely, protection from inclement weather, excellent visibility into and out of the shelter, simple access and egress capability and aesthetic appeal, to encourage transit usage. Some of these features are provided by the units depicted in U.S. Pat. No. Des. 248,776, which units have been installed and favorably received. However, the construction of such units requires special individually formed components, typically of wood.

SUMMARY OF THE INVENTION

This invention achieves an exoskeletal structure employing special extruded ribs formed of main elongated mullions or struts, coupled with elongated compression plates complementary to the mullions or struts, for cooperatively defining panel edge receiving and retaining slots to secure the edges of closure panels.

One use presently intended for the structure is as a transit shelter. Therefore, for convenience, the invention will be chiefly described relative thereto although applicable to other uses. The exoskeletal ribs of the structure are spaced in parallel relationship and extend the height and length of the shelter. The ribs retain an intermediate panel means covering the top and ends of the shelter. Side panels enclosing portions of the sides are retained by the main mullions or struts of these ribs and/or supplemental mullions or struts.

BRIEF DESCRIPTION OF THE DRAWINGS

FIG. 1 is a side elevational view of a transit shelter embodying the invention;

FIG. 2 is an end elevational view of the shelter in FIG. 1;

FIG. 3 is an enlarged side elevational view of a compression plate section forming part of the rib structure of the invention;

FIG. 5 is an end elevational view of the compression plate in FIG. 3, viewed from the right end thereof;

FIG. 6 is a further enlarged cross-sectional view of the compression plate;

FIG. 7 is a greatly enlarged fragmentary portion of the compression plate;

DESCRIPTION OF THE PREFERRED EMBODIMENT

Figure 4:
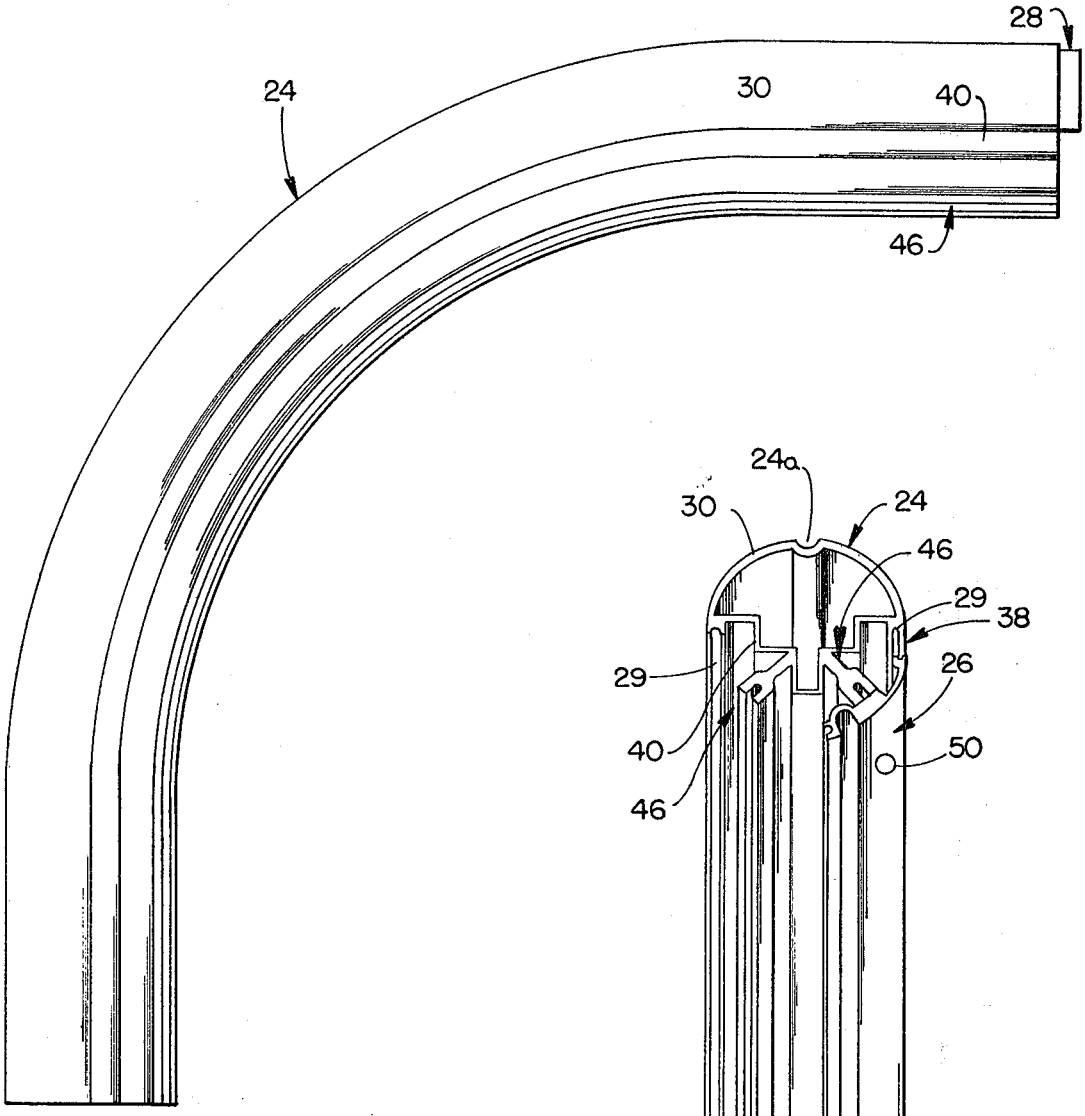
FIG. 4 is an enlarged side elevational view of a mullion or strut of the rib structure.

With reference to FIGS. 1 and 2, there is disclosed a preferred embodiment of the invention, incorporated in the form of a shelter, specifically a transit shelter 10. This transit shelter is shown to include laterally spaced, parallel, curvilinear, exoskeletal ribs 12 including portions 11 extending vertically the height of the structure on both ends thereof, and portions 13 extending longitudinally the length of the structure. These ribs form framing for an elongated panel means 14 enclosing the space between the ribs at the opposite ends and across the top of the shelter. The ribs support and retain the panels which are of a matching configuration. Preferably such panel means includes a transparent portion 14' for optimum vision into and out of the shelter and for light entry to the sheltered space.

Lower ends 17 of ribs 12 also curve inwardly toward each other and then back up to the top or longitudinal rib portions 13 to define side zones. Side panels 16 are retained within the side zones. Such side panels constitute transparent, translucent and/or decorative panels for selected modular zones of the shelter space. Seating 18 may be positioned within the enclosure defined by panel means 14 and side panels 16. The seating is protected from the weather by the shelter.

The structure is of selected length to enclose a desired number of modular zones, e.g. six, as depicted in FIG. 1. In the particular embodiment depicted, two central modular zones 19, 20 are enclosed on opposite sides by additional side panels 116 bounded by portions 13 of ribs 12 on the top and by a double U-shaped supplemental rib assembly 112 on the bottom and side edges. Between panels 16 and 116 are ingress and egress openings, as depicted in FIG. 1. Rib assembly 112 has the same cross-sectional configuration as rib 12 and is formed from mullions and compression plates, as described below.

Figure 13:
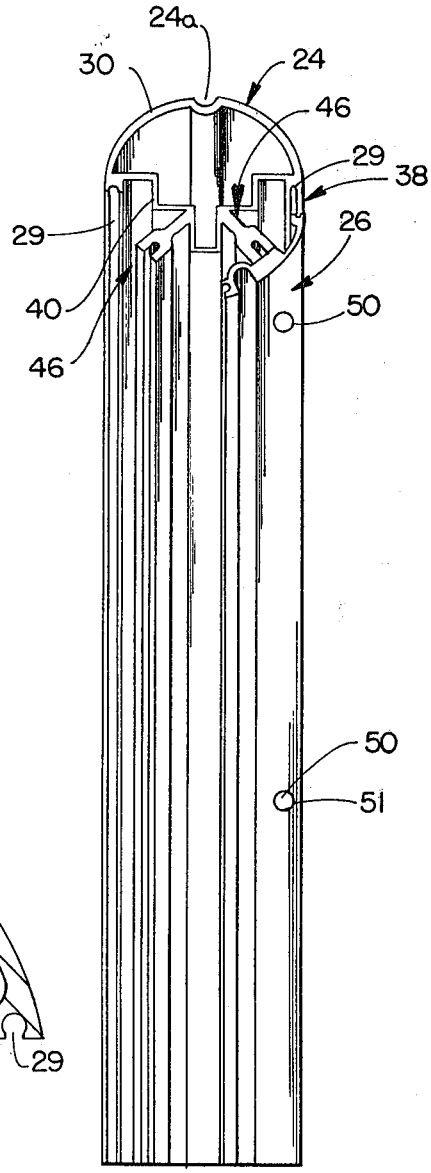
FIG. 13 is an end elevational view of a mullion and one compression plate.
Figure 14:
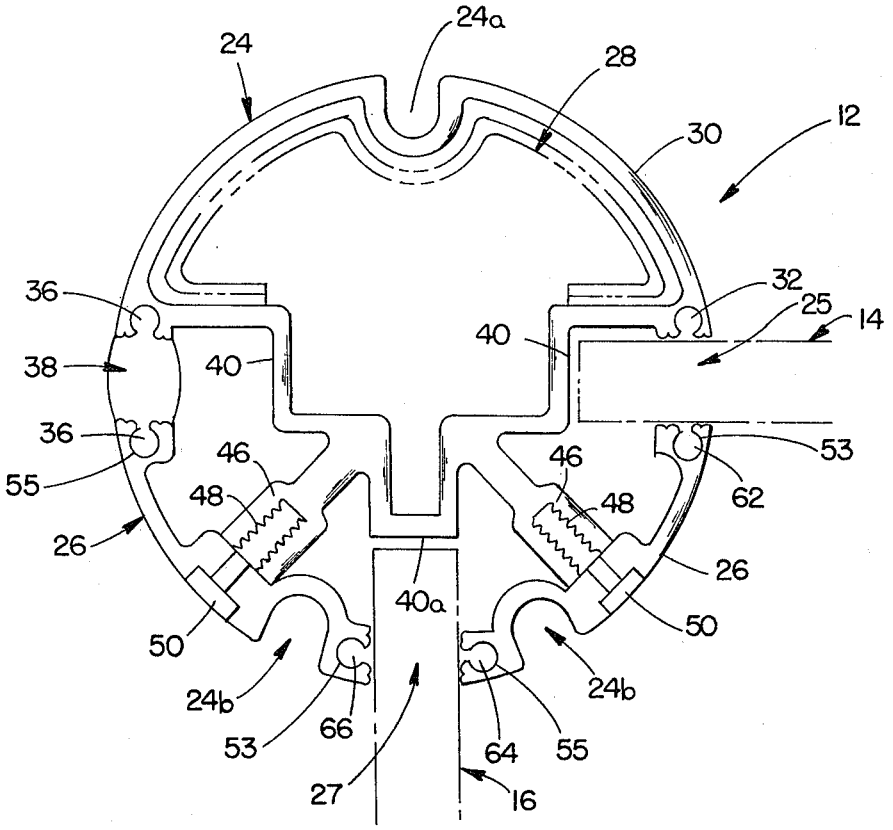
FIG. 14 is a cross-sectional view of an assembled mullion, pair of compression plates, filler gasket and two panels.

Each rib 12 is an assembly of components, as depicted in FIGS. 3–14. These components include a special mullion or strut 24 (FIGS. 4, 8–10) and compression plates 26 (FIGS. 3, 5–7) cooperatively interconnected to retain and seal the panels 14 and 16, as shown in FIG. 14.

Figure 11:
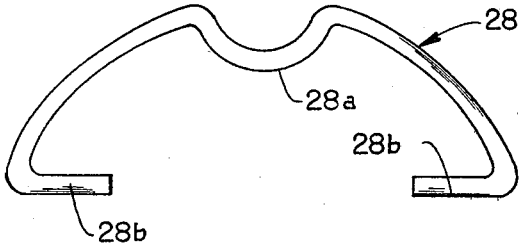
FIG. 11 is a cross-sectional view of a joint connector internal sleeve for connecting two mullions end to end.
Figure 12:
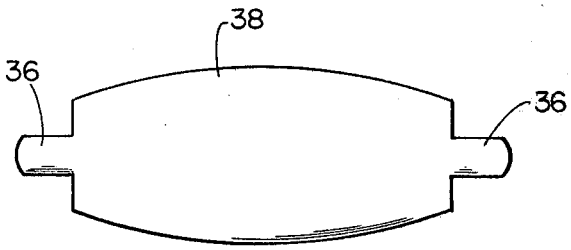
FIG. 12 is a cross-sectional view of a filter gasket for interfitting between the mullion and a compression plate when that opening is not used for an enclosure panel.

Referring firstly to mullion 24, each longitudinal portion thereof is either a curvilinear portion, e.g., a 90° curved segment, as depicted in FIG. 4, or a linear portion. The linear portion normally has ends in abutment with the ends of curvilinear portions. These end-to-end abutting mullions are aligned and interconnected by a like shaped, sliding internal sleeve or connector 28 (FIG. 11). Sleeve 28 is shown extending from an end of mullion 24 in FIG. 4. The cross section of the internal sleeve preferably includes a central offset **28*a* to accommodate the offset forming the cavity or groove 24*a* in mullion 24, and also includes a pair of flanges 28*b*** to form a snug fit within the mullion interior, as explained below. Alternatively, the individual mullions can be of compound configuration so as to be jointless, i.e. including both the linear and curved portions integrally.

Figure 8:
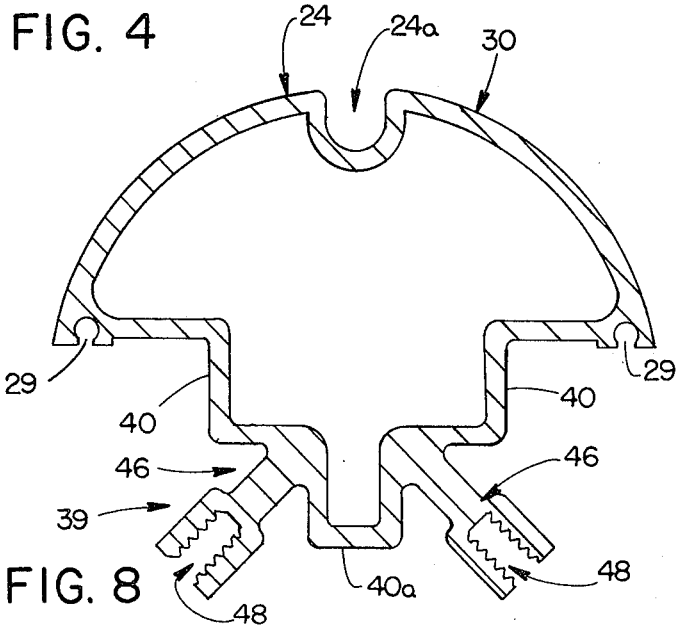
FIG. 8 is an enlarged cross-sectional view of the mullion or strut.
Figure 9:
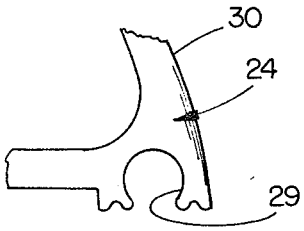
FIG. 9 is a greatly enlarged cross-sectional view of a portion of the mullion or strut in FIG. 8.

As seen in FIG. 8, the cross-sectional shape of the mullion includes a semicircular exterior surface 30 extending basically 180° but terminating short of the transverse centerline thereof. The mullions are "hollow" and box-like in configuration. The mullion cooperatively defines a pair of panel receiving slots 25, 27 with adjacent arcuately curved compression plates, e.g. plate 26 forming the slot for panel 14 in FIG. 14. Adjacent each panel slot is a groove 29 to receive either a resilient gasket 32 in FIG. 14 or a cooperatively configurated protrusion 36 of a filler member 38 if a panel is not inserted in a particular slot.

Figure 10:
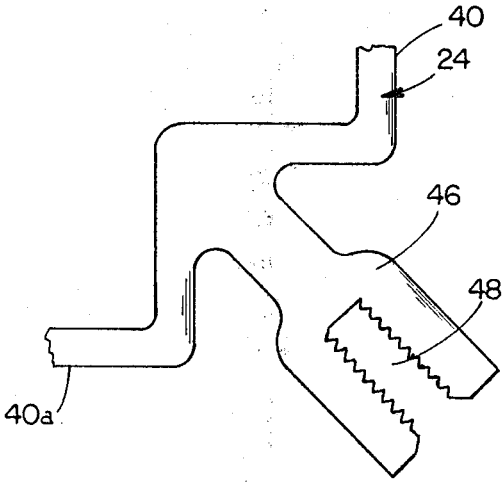
FIG. 10 is a greatly enlarged second portion of the mullion or strut in FIG. 8 showing a screw boss for fastening the compression plate section.

The mullion has a central protrusion 39 defining three panel edge abutment surfaces. These surfaces include a pair of opposite panel edge abutment surfaces 40 on opposite sides, basically normal to the receiving slots formed between the mullion and the compression plates, and a third panel edge abutment surface 40*a* oriented normal to the surfaces 40 and normal to the receiving slot for its respective panel 16, for abutment with the edge of panel 16. This last noted receiving slot, i.e. for panel 16, is formed between the edges of mirror image compression plates. Panel 16 extends generally normal to panel 14. Projecting diagonally from central protrusion 39 of the mullion are a pair of elongated, bifurcated connector elements 46 (FIGS. 10 and 13). Each element 46 defines an elongated ribbed slot 48 capable of receiving threaded fasteners 50 at any position along the slots. Fasteners 50 protrude through openings 51 (FIGS. 6 and 13) in compression plates 26 for insertion into slots 48 to fasten the compression plates to the mullions. Mullion 24, as seen in FIG. 8, is symmetrical about a vertical centerline.

The mullions are preferably extruded from aluminum or other suitable material. The compression plates 26 are also extruded from aluminum or other suitable material.

The elongated compression plates 26, as seen in FIG. 14, are arcuate in cross-sectional configuration, each including a pair of elongated cavities 53, 55 on their opposite lateral edges. Cavities 53, 55 receive resilient gaskets 62 and 64, as in the compression plate on the right in FIG. 14, or they may receive a resilient gasket 66 and a protruding lip 36 of a filler 38, as depicted by the compression plate on the left in FIG. 14. Plates 26 are either linearly extending (FIG. 5) or curved (FIG. 3) to match the configuration of a mullion with which they are used. Also, each plate 26 defines an elongated groove 24*b* opening through an outer surface thereof.

Assembly of the structure is as follows. A unitary mullion having the linear and curvilinear portions for the desired overall length and height is selected for the ribs. Alternatively, each is formed by interconnecting curved and linear mullions. Internal sleeves 28 are slid inposition in telescoping relationship with the end-to-end abutted mullions, as depicted by the phantom lines in FIG. 14 at 28.

Next, the elongated compression plates 26 are loosely attached by fasteners 50 extending through openings 51 therein and into ribbed slots 48 of bifurcated flanges 46. For each of the receiving slots that will retain a panel, appropriate gaskets, e.g. 32 and 62 for panel 14, and 64 and 66 for panel 16, are inserted. A filler member 38 is positioned with its lip portions 36 extending into the grooves of the remaining slot. The gaskets and filler member preferably extend the length of the respective slots. Panel members 14 and 16, or the equivalent, are then inserted between the gaskets into these slots into abutment with stop surfaces 40 and 40*a*. Fasteners 50 are then tightened to squeeze the gaskets against the opposite edges of the panels which are "compressed" between the mullion and plates and held under pressure. This secures the panels in position and seals them against weather elements. Light sources (not shown) may be inserted within cavities or grooves 24*a*, 24*b* on the mullion or plate. The shelter lends itself to sale in kit form with all necessary parts to form the shelter. The mullions, plates, sleeves, gaskets and filler elements could be sold by the manufacturer. The ultimate assembler could supply the panels.

It is conceivable that certain variations in the construction set forth may be made within the scope of the inventive concept presented. Therefore, the invention is not intended to be limited to the specific embodiment set forth as illustrative of the concept, but only by the scope of the appended claims and the reasonable equivalents thereto.

The embodiments of the invention in which an exclusive property or privilege is claimed are defined as follows:

1. An elongated rib for defining the frame of a shelter which includes at least one panel, said rib comprising:

an elongated mullion having a hollow, box-like configuration, said mullion defining an exterior surface joined to a central protrusion, said protrusion defining a panel abutment surface, and said mullion further including a connector element extending from said protrusion;

an elongated plate having lateral edges;

fastener means engaging said plate for securing said plate to said connector element, one of said lateral edges of said plate and said mullion defining a slot for receipt of a panel, said mullion and plate being dimensioned so that a panel is held under pressure within said slot, said mullion further defining another panel abutment surface oriented substantially normal to said panel abutment surface;

another elongated plate, said mullion including another connector element and said another plate and said mullion defining another panel receiving slot extending generally normal to said a slot; and additional fastener means engaging said another elongated plate for securing said another plate to said another connector element of mullion.

2. An elongated rib as defined by claim 1 wherein said mullion further defines an elongated gasket cavity opening into said slot.

3. An elongated rib as defined by claim 2 wherein said plate defines another elongated gasket cavity opening into said slot.

4. An elongated rib as defined by claim 1 wherein said connector element extends at an angle from said protrusion and defines an elongated ribbed slot engaged by said fastener means.

5. An elongated rib as defined by claim 3 wherein said connector element extends at an angle from said protrusion and defines an elongated, ribbed slot engaged by said fastener means

6. An elongated rib for defining the frame of a shelter which includes at least one panel, said rib comprising:

an elongated mullion having a hollow, box-like configuration, said mullion defining an exterior surface joined to a central protrusion, said protrusion defining a panel abutment surface, and said mullion further including a connector element extending from said protrusion;

an elongated plate having lateral edges;

fastener means engaging said plate for securing said plate to said connector element, one of said lateral edges of said plate and said mullion defining a slot for receipt of a panel, said mullion and plate being dimensioned so that a panel is held under pressure within said slot, said mullion further defining an elongated gasket cavity opening into said slot, said plate defining another elongated gasket cavity opening into said slot;

a pair of elongated resilient gaskets, each disposed in one of said elongated gasket cavities, said gaskets positioned and dimensioned to sealingly engage a panel disposed within said slot, said mullion further defining another panel abutment surface oriented substantially normal to said a panel abutment surface;

another elongated plate, said mullion including another connector element, and said another plate and said mullion defining another panel receiving slot extending generally normal to said a slot; and additional fastener means engaging said another elongated plate for securing said another plate to said another connector element of mullion.

7. An elongated rib as defined by claim 6 wherein said connector elements extend at an angle from said protrusion and each defines an elongated ribbed slot engaged by one of said fastener means.

8. An elongated rib as defined by claim 7 further including an elongated filler element extending between and carried by said mullion and said another elongated plate.

9. An exoskeletal shelter, comprising:

a pair of laterally spaced, longitudinally extending ribs defining the exterior configuration of said shelter, each of said ribs including:

an elongated, one-piece strut defining an exterior surface and a protrusion, said protrusion defining a panel abutment surface, said strut further defining a connector element extending from said protrusion;

an elongated, one-piece plate having lateral edges, said strut and said plate dimensioned to define a panel receiving slot into which a panel may be positioned against said panel abutment surface;

fastener means engaging said plate for fastening said plate to said strut at said connector element, said strut and said plate dimensioned to hold a panel under pressure within the slot; and an elongated panel extending between said ribs and having edges received within the slots defined by said ribs, said panel defining a top for said shelter.

10. An exoskeletal shelter as defined by claim 9 wherein said strut of each of said ribs defines another panel abutment surface which is oriented generally normal to said a panel abutment surface.

11. An exoskeletal shelter, comprising:

a pair of laterally spaced, longitudinally extending ribs defining the exterior configuration of said shelter, each of said ribs including:

an elongated strut defining a panel abutment surface;

an elongated plate having lateral edges, said strut and said plate dimensioned to define a panel receiving slot into which a panel may be positioned against said panel abutment surface;

fastener means engaging said plate for fastening said plate to said strut, said strut and said plate dimensioned to hold a panel under pressure within the slot; and an elongated panel extending between said ribs and having edges received within the slots defined by said ribs, said panel defining a top for said shelter, said strut of each of said ribs defining another panel abutment surface which is oriented generally normal to said a abutment surface, and wherein said strut of each of said ribs further includes elongated connector elements, and wherein said strut of each of said ribs defines still another panel abutment surface which is generally normal to said another panel abutment surface, and wherein said ribs each include another elongated plate, said plates being secured to said strut at said connector elements by said fastener means, said strut and said plates defining an additional panel receiving slot.

12. An exoskeletal shelter as defined by claim 11 further including side panels disposed within said additional panel receiving slots and defining sides of said shelter.

13. An exoskeletal shelter as defined by claim 12 wherein said strut of each of said ribs defines elongated gasket cavities opening into said slots and each of said plates defines elongated gasket cavities along their lateral edges which open into said slots.

14. An exoskeletal shelter as defined by claim 13 further including:

a plurality of resilient gaskets, each disposed within one of said gasket cavities and sealingly engaging one of said panels disposed within said slots.

15. An exoskeletal shelter as defined by claim 14 further including an elongated filler member extending between and secured to said strut and said another elongated plate.

16. An exoskeletal shelter as defined by claim 15 wherein said strut is hollow and includes an exterior surface and a protrusion defining said panel abutment surfaces.

17. An exoskeletal shelter as defined by claim 16 wherein each of said ribs includes a plurality of said struts and plates with ends in abutting relationship and wherein said shelter further includes:

a plurality of internal sleeves disposed within said struts and extending in telescoping relationship with the ends of abutting struts to interconnect said struts and plates.

18. An exoskeletal shelter as defined by claim 16 wherein each of said connector elements defines an elongated, ribbed slot opening toward one of said plates, said fastener means extending into and engaging said slot.

19. An exoskeletal shelter as defined by claim 18 wherein each of said struts is symmetrical about a vertical centerline and said plates are mirror images of each other.

20. An exoskeletal shelter as defined by claim 17 wherein each of said connector elements defines an elongated, ribbed slot opening toward one of said plates, said fastener means extending into and engaging said slot.

21. An exoskeletal shelter as defined by claim 20 wherein each of said struts is symmetrical about a vertical centerline and said plates are mirror images of each other.

22. An exoskeletal shelter as defined by claim 21 wherein said struts and said plates are extruded from aluminum.

23. A kit for forming a shelter, said kit comprising:

a plurality of elongated ribs adapted to be positioned in laterally spaced relationship to define a shelter frame, each of said ribs including:

an elongated, one-piece, extruded strut defining a plurality of panel abutment surfaces;

an elongated, one-piece, extruded, compression plate having lateral edges and which is adapted to be secured to said strut, said strut and said plate dimensioned to define a panel receiving slot into which a panel may be positioned against one of said panel abutment surfaces, and said strut and said plate each defining a gasket cavity opening into said slot;

fastener means adapted to engage said plate for fastening said plate to said strut, said strut and said plate dimensioned to hold a panel under pressure within the slot; and a plurality of resilient gaskets, each adapted to be disposed within one of said gasket cavities.

24. A kit as defined by claim 23 wherein one of said panel abutment surfaces is oriented generally normal to another of said abutment surfaces.

25. A kit for forming a shelter, said kit comprising:

a plurality of elongated ribs adapted to be positioned in laterally spaced relationship to define a shelter frame, each of said ribs including:

an elongated strut defining a plurality of panel abutment surfaces;

an elongated plate having lateral edges and which is adapted to be secured to said strut, said strut and said plate dimensioned to define a panel receiving slot into which a panel may be positioned against one of said panel abutment surfaces; and fastener means adapted to engage said plate for fastening said plate to said strut, said strut and said plate dimensioned to hold a panel under pressure within the slot, one of said panel abutment surfaces being oriented generally normal to another of said abutment surfaces, and wherein said strut of each of said ribs further includes elongated connector elements, and wherein said ribs each include another elongated plate, said plates being securable to said strut at said connector elements by said fastener means, said strut and said plates adapted to define additional panel receiving slots.

26. A kit as defined by claim 25 further including a plurality of panels adapted to be disposed within said panel receiving slots.

27. A kit as defined by claim 25 wherein said strut of each of said ribs defines elongated gasket cavities opening into said slots and each of said plates defines elongated gasket cavities along their lateral edges which open into said slots when said plates are secured to said strut.

28. A kit as defined by claim 27 further including:

a plurality of resilient gaskets, each adapted to be disposed within one of said gasket cavities and to sealingly engage a panel disposed within said slots.

29. A kit as defined by claim 28 further including an elongated filler member adapted to extend between and to be secured to said strut and said another elongated plate.

30. A kit as defined by claim 29 wherein each of said struts is hollow and includes an exterior surface and a protrusion defining said panel abutment surfaces.

31. A kit as defined by claim 30 further including a plurality of internal sleeves adapted to be inserted into one of said struts to interconnect said struts in an end-to-end abutting relationship.

32. A kit as defined by claim 31 wherein each of said connector elements defines an elongated, ribbed slot opening toward one of said plates, said fastener means adapted to extend into and engage said slot.

33. A kit as defined by claim 32 wherein each of said struts is symmetrical about a vertical centerline and said plates are mirror images of each other.

34. A kit as defined by claim 33 further including a plurality of panels adapted to be disposed within selected ones of said panel receiving slots to define a top, ends and sides of the shelter.

* * * * *